US010974800B1

(12) United States Patent
Duthie

(10) Patent No.: US 10,974,800 B1
(45) Date of Patent: Apr. 13, 2021

(54) SELF INFLATING FLOAT ASSEMBLY

(71) Applicant: Glenn Duthie, Bloomington, IN (US)

(72) Inventor: Glenn Duthie, Bloomington, IN (US)

( * ) Notice: Subject to any disclaimer, the term of this patent is extended or adjusted under 35 U.S.C. 154(b) by 0 days.

(21) Appl. No.: 16/591,791

(22) Filed: Oct. 3, 2019

(51) Int. Cl.
*B63C 9/08* (2006.01)
*B63C 9/15* (2006.01)
*B60C 29/00* (2006.01)

(52) U.S. Cl.
CPC ..... *B63C 9/155* (2013.01); *B63C 9/24* (2013.01)

(58) Field of Classification Search
CPC ..... B63C 9/08; B63C 9/081; B63C 9/082; B63C 9/11; B63C 9/125; B63C 9/13; B63C 9/15; B63C 9/155; B63C 9/18; B63C 9/24; B63B 59/02; B63B 2059/025
USPC ..... 441/8, 88, 90, 106, 111–118, 123, 441/125–132
See application file for complete search history.

(56) References Cited

U.S. PATENT DOCUMENTS 3,618,630 A * 11/1971 Marcaccio ..... B60C 23/0496 137/227
3,925,838 A 12/1975 Kennedy
5,466,179 A 11/1995 Jeffrey, Sr.
5,692,933 A * 12/1997 Bradley ..... B63C 9/1255 441/106
5,735,719 A * 4/1998 Berg ..... B63C 11/26 441/11
6,394,867 B1 * 5/2002 Bianco ..... B63C 9/04 114/360
6,659,825 B2 12/2003 Foss
7,059,925 B2 * 6/2006 Smith ..... B63C 9/1255 441/106
7,322,868 B2 * 1/2008 Ross ..... B63B 34/50 441/130
8,961,250 B2 * 2/2015 Meyer ..... B63B 22/22 441/31
9,022,825 B1 * 5/2015 Meyer ..... B63B 22/22 441/39
2003/0032507 A1 2/2003 Lacroix
2003/0200910 A1 10/2003 Corlett
2012/0034831 A1 2/2012 Andrea
2019/0061889 A1 * 2/2019 Cardi ..... B63C 9/155

* cited by examiner

*Primary Examiner* — Daniel V Venne

(57) ABSTRACT

A self inflating float assembly includes a tube that is comprised of a resiliently expandable material. The tube has an air port extending into an interior of the tube thereby facilitating the tube to self inflate. Additionally, the tube is comprised of a fluid impermeable thereby facilitating the tube to float when the tube is inflated for performing as a personal floatation device. A valve is rotatably coupled to the air port. The valve is positionable in an open condition thereby facilitating air to pass through the air port for inflating or deflating the tube. The valve is positionable in a closed condition thereby inhibiting air from passing through the air port for retaining the tube at a selected degree of inflation.

9 Claims, 7 Drawing Sheets

SELF INFLATING FLOAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to float device and more particularly pertains to a new float device facilitating a float to be self inflated.

(2) Description of Related Art Including Information Disclosed Under 37 CFR 1.97 and 1.98

The prior art relates to float device.

BRIEF SUMMARY OF THE INVENTION

An embodiment of the disclosure meets the needs presented above by generally comprising a tube that is comprised of a resiliently expandable material. The tube has an air port extending into an interior of the tube thereby facilitating the tube to self inflate. Additionally, the tube is comprised of a fluid impermeable thereby facilitating the tube to float when the tube is inflated for performing as a personal floatation device. A valve is rotatably coupled to the air port. The valve is positionable in an open condition thereby facilitating air to pass through the air port for inflating or deflating the tube. The valve is positionable in a closed condition thereby inhibiting air from passing through the air port for retaining the tube at a selected degree of inflation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
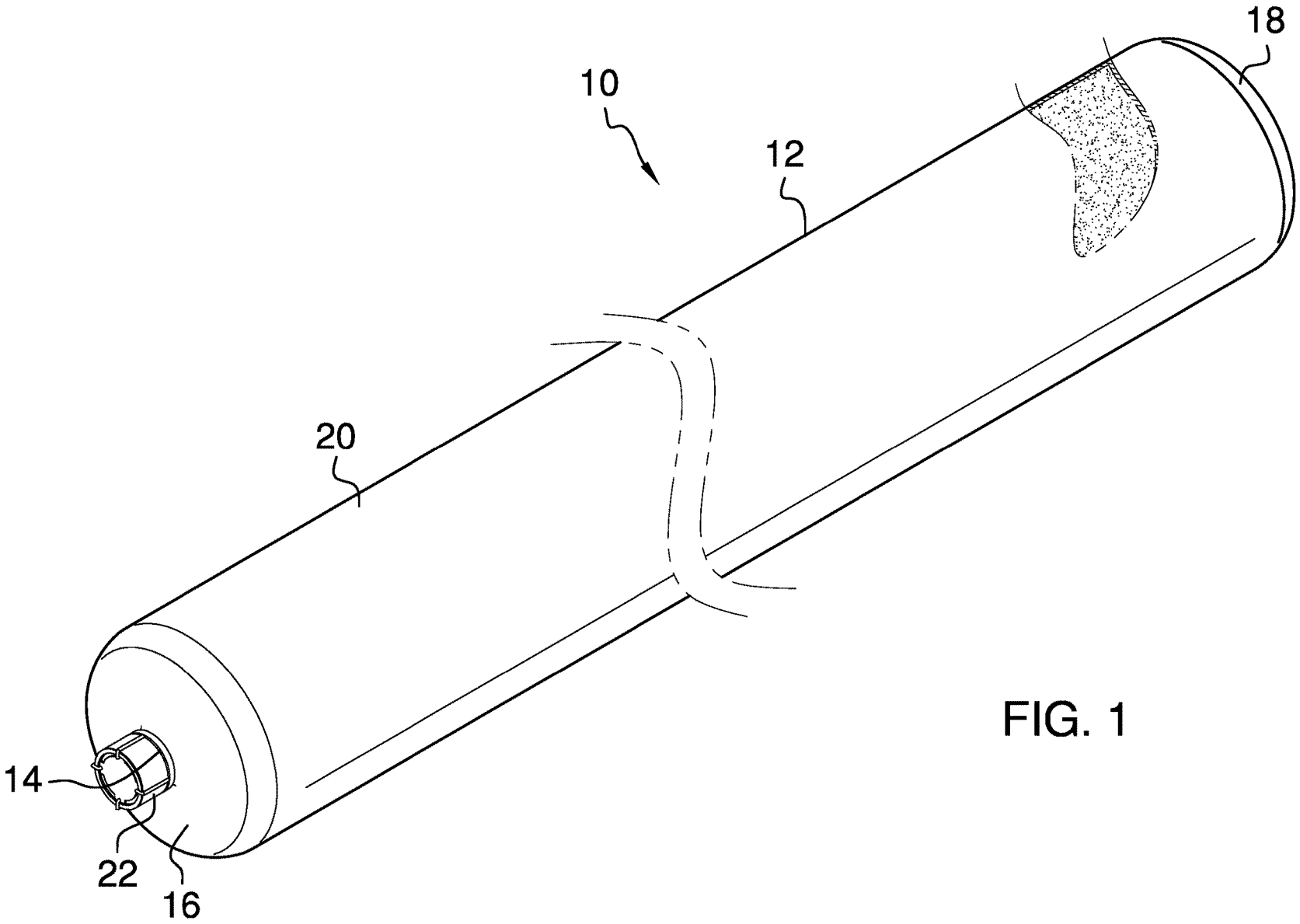
FIG. 1 is a perspective view of a self inflating float assembly according to an embodiment of the disclosure.
Figure 2:
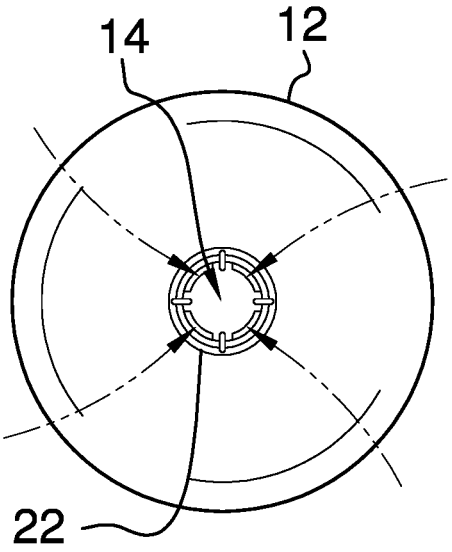
FIG. 2 is a front view of an embodiment of the disclosure showing a tube being inflated.
Figure 3:
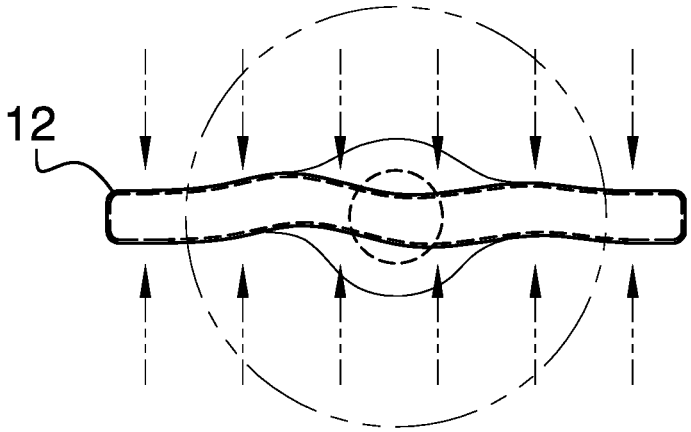
FIG. 3 is a back view of an embodiment of the disclosure showing a tube being deflated.

With reference now to the drawings, and in particular to FIGS. 1 through 9 thereof, a new float device embodying the principles and concepts of an embodiment of the disclosure and generally designated by the reference numeral 10 will be described.

As best illustrated in FIGS. 1 through 9, the self inflating float assembly 10 generally comprises a tube 12 that is comprised of a resiliently expandable material. The tube 12 has an air port 14 extending into an interior of the tube 12 thereby facilitating the tube 12 to self inflate. Additionally, the tube 12 is comprised of a fluid impermeable thereby facilitating the tube 12 to float when the tube 12 is inflated. In this way the tube 12 can perform as a personal floatation device. The tube 12 is flattenable for deflating the tube 12 for storage.

The tube 12 has a first end 16, a second end 18 and an outer wall 20 extending therebetween. The tube 12 is elongated between the first end 16 and the second end 18, and the air port 14 extends through the first end 16. A valve 22 is provided and the valve 22 is rotatably coupled to the air port 14. The valve 22 is positionable in an open condition thereby facilitating air to pass through the air port 14 for inflating or deflating the tube 12. Additionally, the valve 22 is positionable in a closed condition thereby inhibiting air from passing through the air port 14 for retaining the tube 12 at a selected degree of inflation. The valve 22 may be a brass air valve commonly employed on self inflating mattresses or the like.

A strap 24 is provided and the strap 24 is removably coupled to the tube 12. The tube 12 is bendable into a U-shape and the strap 24 retains the tube 12 in the U-shape. In this way the tube 12 can be positioned around a user's neck for wearing the personal floatation device. The outer wall 20 of the tube 12 has a pair of loops 26 being coupled thereto and the strap 24 extends through each of the loops 26. Each of the loops 26 is positioned adjacent to a respective one of the first end 16 and the second end 18 of the tube 12. Additionally, a pair of buckles 27 may each be coupled to opposite ends of the strap 24 for engaging each other and forming the strap 24 into a closed loop.

Figure 4:
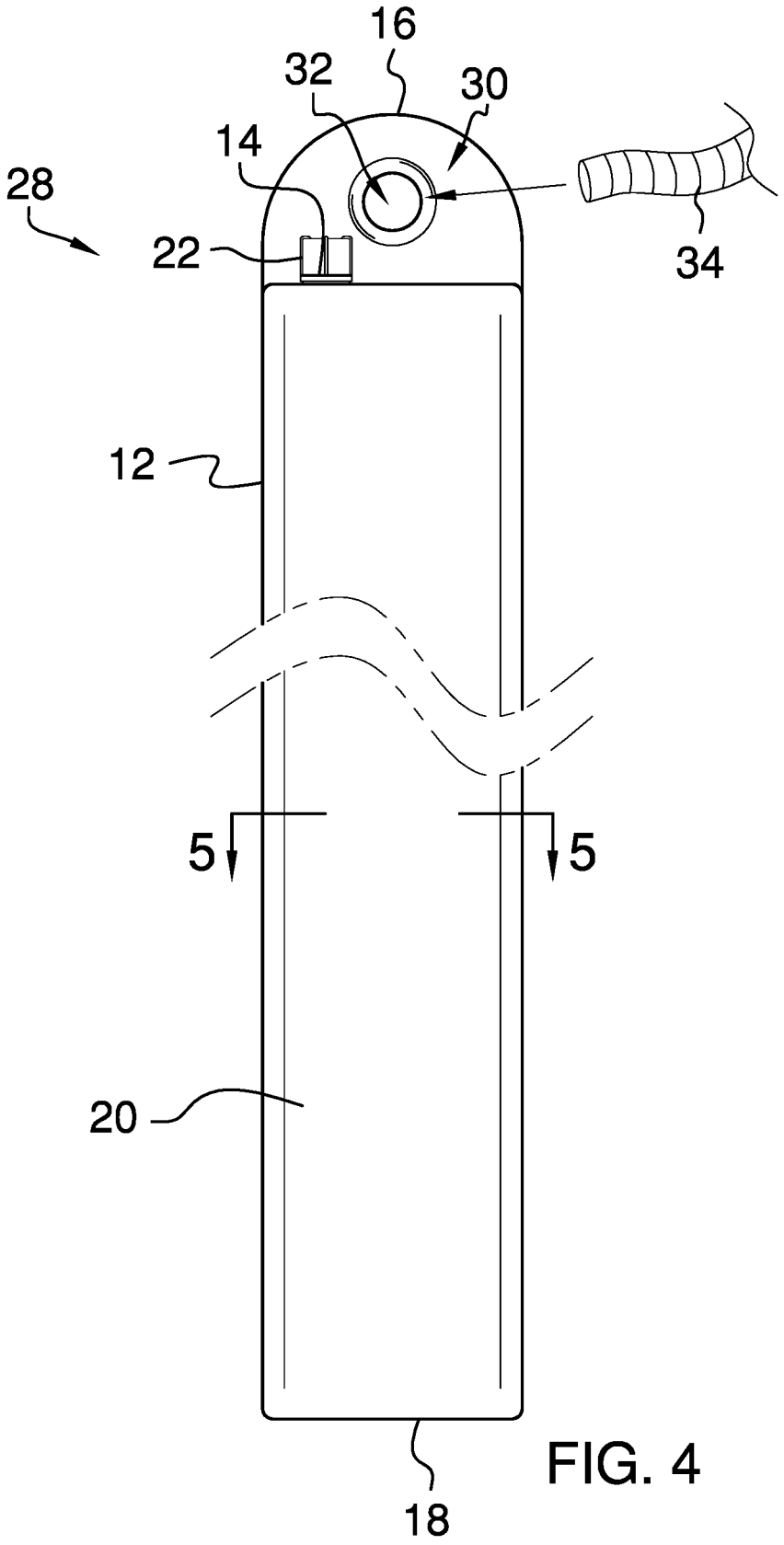
FIG. 4 is a top view of an alternative embodiment of the disclosure.
Figure 5:
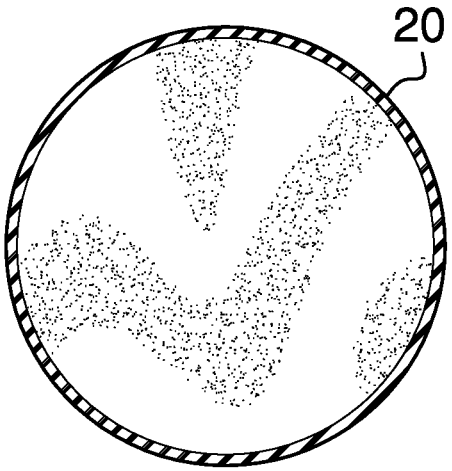
FIG. 5 is a cross sectional view taken along line 4-4 of FIG. 4 of an embodiment of the disclosure.

In an alternative embodiment 28 as is shown in FIG. 4, the outer wall 20 has a flattened portion 30 extending from the first end 16 toward the second end 18. Additionally, the outer wall 20 has an opening 32 extending through the flattened portion 30 for insertably receiving a suspension 34. In this way the tube 12 can be suspended in the convention of a dock cushion on a boat. The suspension 34 may be a rope, a clamp, a cable or any other suspension that can be passed through the opening 32.

Figure 6:
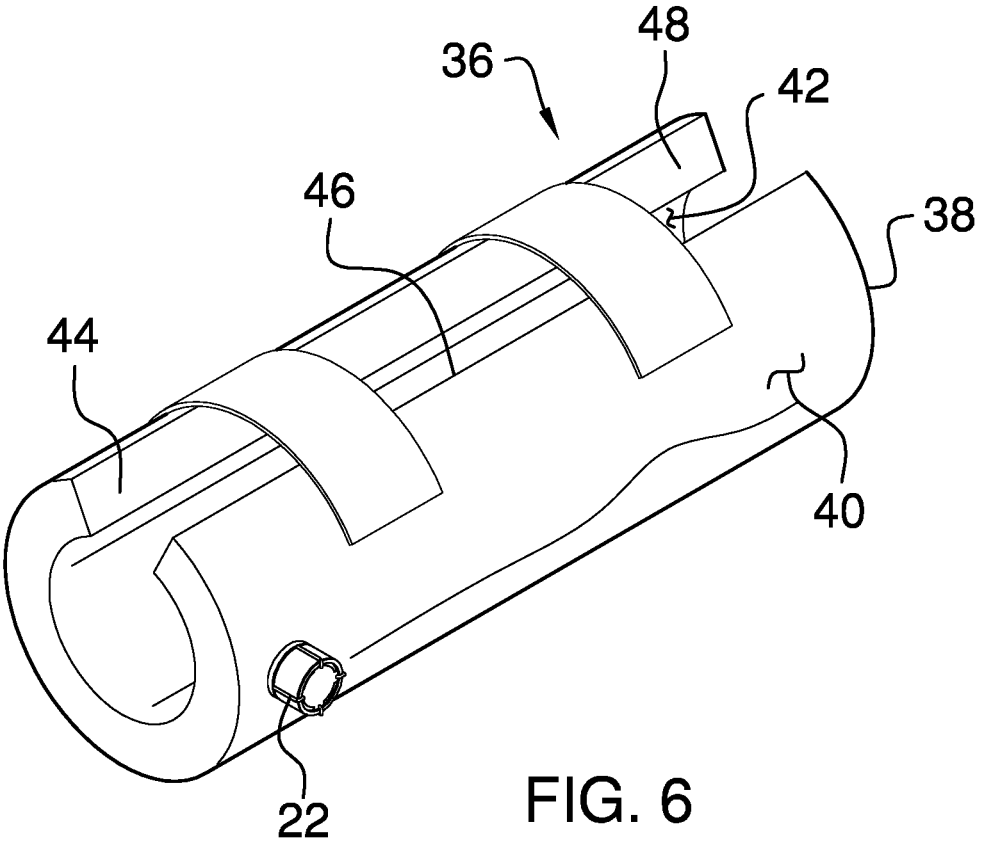
FIG. 6 is a top perspective view of an alternative embodiment of the disclosure.
Figure 7:
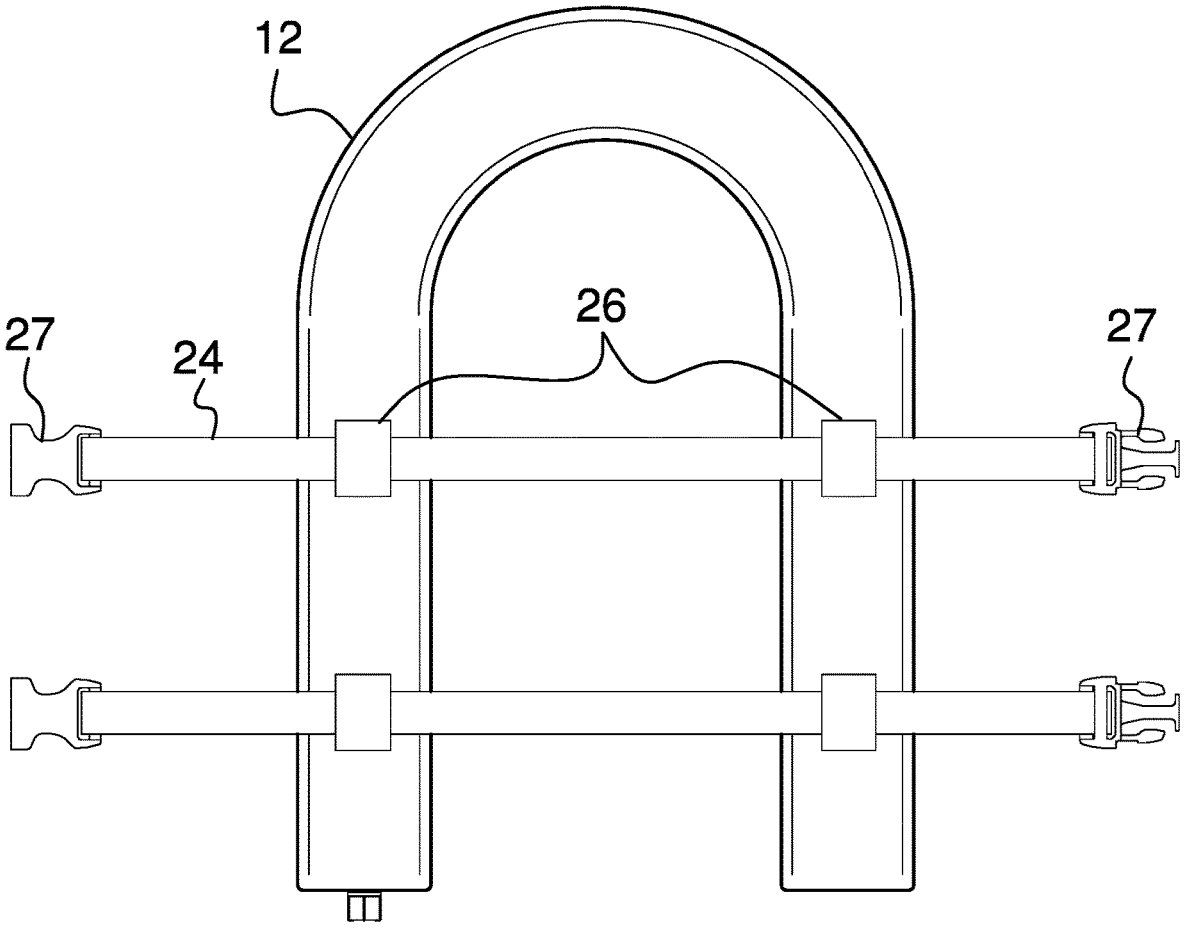
FIG. 7 is a bottom view of an embodiment of the disclosure.

In an alternative embodiment 36 as is most clearly shown in FIG. 6, a panel 38 is provided that that is comprised of a resiliently expandable material. The air port 14 extends into an interior of the panel 38 thereby facilitating the panel 38 to self inflate. The panel 38 is comprised of a fluid impermeable thereby facilitating the panel 38 to float when the panel 38 is inflated for performing as a floatation device. The panel 38 has a top surface 40, a bottom surface 42 and an exterior wall 44 extending therebetween, and the air port 14 extends through the exterior wall 44. The panel 38 is bendable into a tubular shape having each of a first lateral side 46 of the exterior wall 44 and a second lateral side 48 of the exterior wall 44 being spaced apart from each other. The strap 24 extends across the first lateral side 46 and the second lateral side 48 of the exterior wall 44 to retain the panel 38 in the tubular shape.

Figure 8:
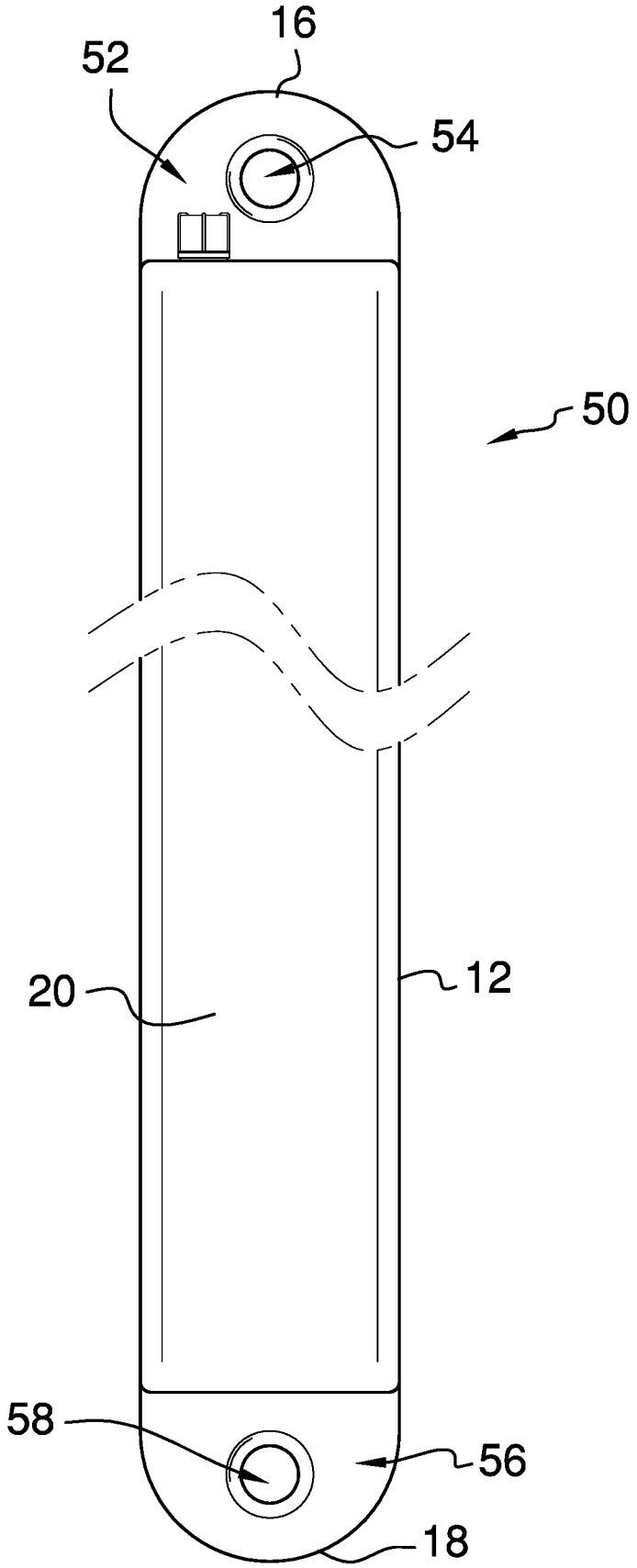
FIG. 8 is a bottom view of an alternative embodiment of the disclosure.

In an alternative embodiment 50 as is most clearly shown in FIG. 8, the outer wall 20 of the tube 12 has a first flattened portion 52 extending from the first end 16 toward the second end 18. The outer wall 20 has a first opening 54 extending through the first flattened portion 52 for insertably receiving a suspension 34 for suspending the tube 12 in the convention of a dock cushion on a boat. The outer wall 20 has a second flattened portion 56 extending from the second end 18 toward the first end 16. The outer wall 20 has a second opening 58 extending through the second flattened portion 56 for insertably receiving a suspension 34 for suspending the tube 12 in the convention of a dock cushion on a boat.

Figure 9:
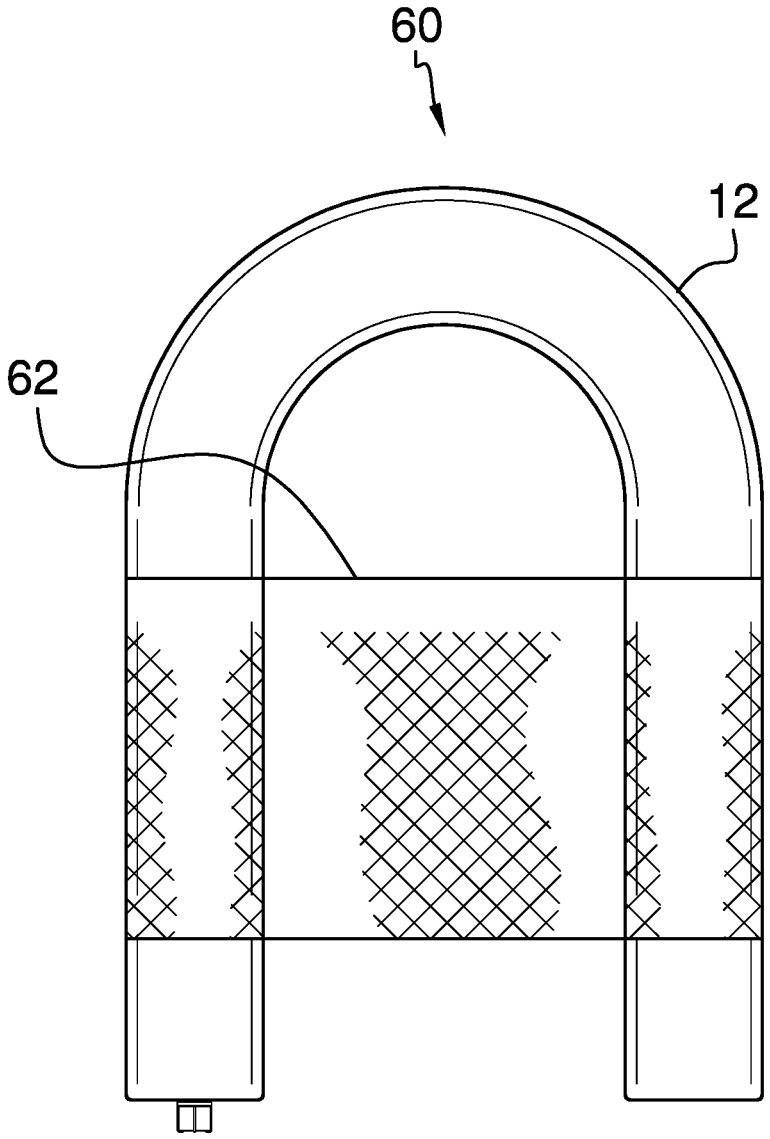
FIG. 9 is a bottom perspective view of an alternative embodiment of the disclosure.

In an alternative embodiment 60 as shown in FIG. 9, a net 62 is provided which is continuously arcuate such that the net 62 forms a tubular shape. The tube 12 is insertable into the net 62 when the tube 12 is bent into the tubular shape. Thus, the net 62 retains the tube 12 in the tubular shape when the tube 12 is inserted into the net 62.

In use, the valve 22 is positioned in the open condition thereby facilitating the tube 12 to self inflate. The valve 22 is positioned in the closed condition when the tube 12 reaches a desired degree of inflation. In this way the tube 12 is inflated for personal floatation or for use as a dock cushion on a boat. The valve 22 is positioned in the open condition for deflating the tube 12 and rolling up the tube 12 for storage. In this way the tube 12 takes up a minimal amount of storage space and additionally does not pose a tripping hazard from lying on the floor. As shown in the alternative embodiments 28,50 in FIGS. 4 and 7, the tube 12 can be suspended from the suspension for use as a dock cushion on a boat.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A float assembly comprising:

a tube, said tube having an air port extending into an interior of said tube thereby facilitating said tube to be inflated, said tube being flattenable for deflating said tube for storage;

a valve being coupled to said air port, said valve being positionable in an open condition thereby facilitating air to pass through said air port for inflating or deflating said tube, said valve being positionable in a closed condition thereby inhibiting air from passing through said air port for retaining said tube at a selected degree of inflation; and a strap being removably coupled to said tube, said tube being bendable into a U-shape, said strap retaining said tube in said U-shape wherein said tube is configured to be positioned around a user's neck for a personal floatation device, said strap engaging said outer wall of said tube at a pair of points each being positioned adjacent to a respective one of said first end and said second end of said tube;

a panel, said air port extending into an interior of said panel thereby facilitating said panel to be inflated, said panel being flattenable for deflating said panel for storage, said panel having a top surface end, a bottom surface and an exterior wall extending therebetween, said air port extending through said exterior wall, wherein said panel is bendable into a tubular shape having each of said first lateral side of said outer wall and a second lateral side of said exterior wall being spaced apart from each other, said strap extending across said first lateral side and said second lateral side of said exterior wall to retain said panel in said tubular shape.

2. The assembly according to claim 1, wherein said tube has a first end, a second end and an outer wall extending therebetween, said tube being elongated between said first end and said second end, said air port extending through said first end.

3. The assembly according to claim 1, further comprising a strap being removably coupled to said tube, said tube being bendable into a U-shape, said strap retaining said tube in said U-shape wherein said tube is configured to be positioned around a user's neck for a personal floatation device.

4. The assembly according to claim 3, wherein said strap engages an outer wall of said tube at a pair of points each being positioned adjacent to a respective one of a first end and a second end of said tube.

5. A float assembly comprising:

a tube, said tube having an air port extending into an interior of said tube thereby facilitating said tube to be inflated, said tube being flattenable for deflating said tube for storage, said tube having a first end, a second end and an outer wall extending therebetween, said tube being elongated between said first end and said second end, said air port extending through said first end;

a valve being coupled to said air port, said valve being positionable in an open condition thereby facilitating air to pass through said air port for inflating or deflating said tube, said valve being positionable in a closed condition thereby inhibiting air from passing through said air port for retaining said tube at a selected degree of inflation;

a strap being removably coupled to said tube, said tube being bendable into a U-shape, said strap retaining said tube in said U-shape wherein said tube is configured to be positioned around a user's neck for a personal floatation device, said strap engaging said outer wall of said tube at a pair of points each being positioned adjacent to a respective one of said first end and said second end of said tube; and a panel, said air port extending into an interior of said panel thereby facilitating said panel to be inflated, said panel being flattenable for deflating said panel for storage, said panel having a top surface end, a bottom surface and an exterior wall extending therebetween, said air port extending through said exterior wall, wherein said panel is bendable into a tubular shape having each of said first lateral side of said outer wall and a second lateral side of said exterior wall being spaced apart from each other, said strap extending across said first lateral side and said second lateral side of said exterior wall to retain said panel in said tubular shape.

6. The assembly according to claim 5, wherein said outer wall has a flattened portion extending from said first end toward said second end, said outer wall having an opening extending through said flattened portion for insertably receiving a suspension for suspending said tube in the convention of a dock cushion on a boat.

7. The assembly according to claim 5, wherein said outer wall has a first flattened portion extending from said first end toward said second end, said outer wall having a first opening extending through said flattened portion for insertably receiving a suspension for suspending said tube in the convention of a dock cushion on a boat.

8. The assembly according to claim 7, wherein said outer wall has a second flattened portion extending from said second end toward said first end, said outer wall having a second opening extending through said second flattened portion for insertably receiving a suspension for suspending said tube in the convention of a dock cushion on a boat.

9. The assembly according to claim 5, further comprising a net being continuously arcuate such that said net forms a tubular shape, said tube being insertable into said net when said tube is bent into said tubular shape, said net retaining said tube in said tubular shape when said tube is inserted into said net.

* * * * *